United States Patent [19]

Mansheim et al.

[11] 4,273,458

[45] Jun. 16, 1981

[54] WRITING IMPLEMENT

[75] Inventors: James W. Mansheim, Fort Madison; William M. Martz, Donnellson, both of Iowa

[73] Assignee: Textron Inc., Providence, R.I.

[21] Appl. No.: 79,110

[22] Filed: Sep. 26, 1979

[51] Int. Cl.[3] ..... B43K 24/06

[52] U.S. Cl. ..... 401/109; 401/112

[58] Field of Search ..... 401/62, 99, 75, 109, 401/110, 111, 112, 116

[56] References Cited

U.S. PATENT DOCUMENTS

| | | | |
|---|---|---|---|
| 2,898,887 | 8/1959 | Van Haltern | 120/42.03 |
| 3,289,637 | 12/1966 | Tessier | 120/18 |
| 3,298,357 | 1/1967 | Bross | 401/110 |
| 3,771,881 | 11/1973 | Swenson | 401/75 |
| 3,850,531 | 11/1974 | Ackerman | 401/65 |
| 4,025,204 | 5/1977 | Hobbs | 401/109 |
| 4,200,403 | 4/1980 | Chu | 401/99 X |

FOREIGN PATENT DOCUMENTS

| | | | |
|---|---|---|---|
| 1295420 | 5/1969 | Fed. Rep. of Germany | 401/99 |
| 2639299 | 3/1978 | Fed. Rep. of Germany | 401/110 |

*Primary Examiner*—Edward M. Coven

*Attorney, Agent, or Firm*—Thomas E. Frantz

[57] ABSTRACT

The present disclosure provides an integrant drive member for converting oscillating to reciprocating motion in a hand-held implement of the type having an elongate housing with an axially oscillable cap and a longitudinally reciprocal unit. The drive member comprises a pair of coaxial sleeve sections connected by a pair of links. One sleeve section is oscillable conjointly with the cap and the other is reciprocal conjointly with the unit. The links are pivoted at points defined by thin flexible webs formed at generally diametrically opposed positions on contiguous surfaces of the sleeve sections. Upon conjoint oscillation of the cap and the one sleeve section, the links swivel on the webs around the pivot points between folded and erect positions and reciprocate the other sleeve section and unit conjointly between retracted and extended positions.

10 Claims, 14 Drawing Figures

FIG. 1
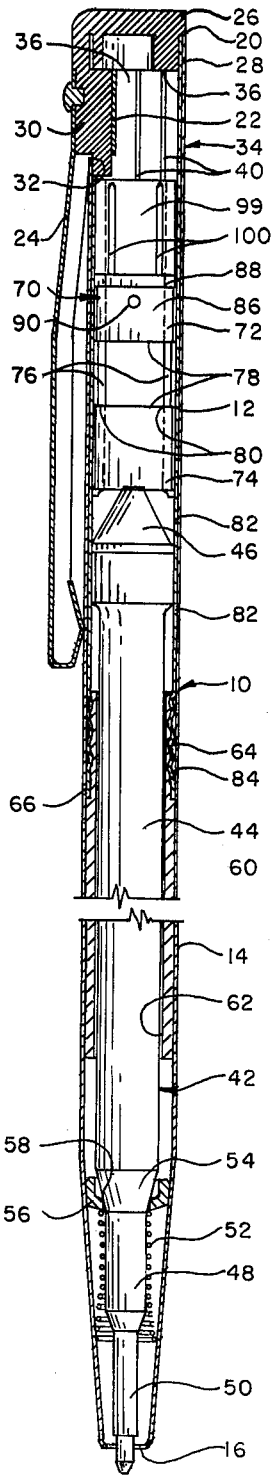
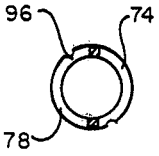
FIG. 3 B
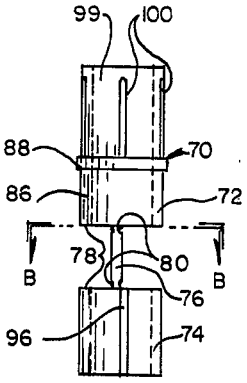
FIG. 3A
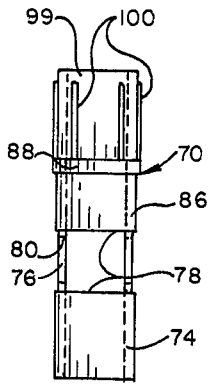
FIG. 3 C
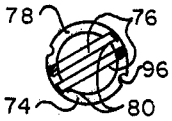
FIG. 4 B
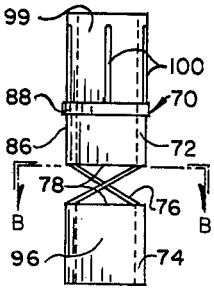
FIG. 4 A
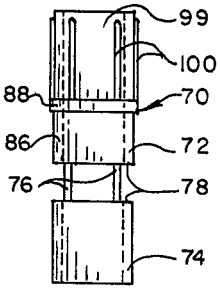
FIG. 4C
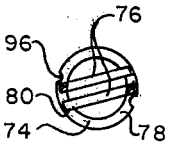
FIG. 5 B
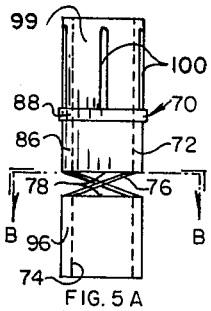
FIG. 5 A
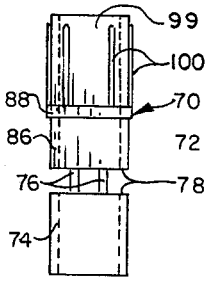
FIG. 5C
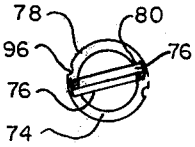
FIG. 6 B
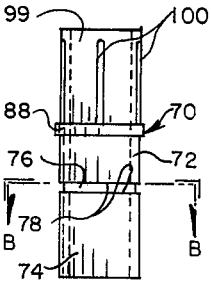
FIG. 6 A
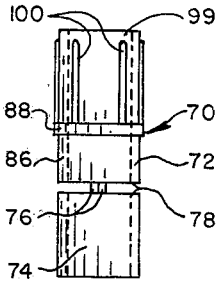
FIG. 6 C

WRITING IMPLEMENT

BACKGROUND OF THE INVENTION

1. Field of the Invention

The present invention relates generally to the field of hand-held implements and more particularly to the type of instrument in which a unit is reciprocated longitudinally between retracted and extended positions in response to axial oscillation of a portion of the instrument housing.

2. Description of the Prior Art

The prior art is replete with proposals for hand-held implements of the type having an elongate housing with a cap, sleeve, ring or similar manually accessible actuating portion which is rotated back and forth (axially oscillated) by the user to shift (reciprocate) a writing, marking or similar unit longitudinally between a retracted (concealed) position within the housing and an extended (point exposed) position projecting through the lower (writing) end of the housing.

Several of these prior proposals have met with some degree of commercial acceptance. Even the more successful structures, however, have been relatively complex and hence difficult and expensive to produce and somewhat inconvenient to use and maintain. For instance, U.S. Pat. Nos.:

| | |
|---|---|
| 3027873 | 3436160 |
| 3176661 | 3597100 |
| 3272184 | 3630629 |
| 3289636 | 3792931 |
| 3289637 | 3917418 |
| 3414359 | |

are representative of various prior art proposals for implements with oscillable type mechanisms which not only are complicated and expensive in terms of the number and complexity of parts and their manufacture and assembly, but in some instances require special units, special unit adapters, or special handling procedures.

The design disclosed in U.S. Pat. No. 4,025,204 eliminates the need for special units or unit adapters or handling procedures, and otherwise provides various structural and functional improvements over the aforementioned prior art. Thus, while comprising a significant advance over such prior art, the mechanism of U.S. Pat. No. 4,025,204 still requires the manufacture and assembly of a number of discrete components—some of which involve relatively close dimensions and tolerances.

Although not specifically directed to oscillable type mechanisms, various attempts have been made in the past to utilize the resiliency or flexibility of certain synthetic resins by combining various of the components used in retractable type writing and marking instruments. For instance, U.S. Pat. Nos. 2,898,887, 3,200,792, 3,298,357 and 3,458,264 propose plastic components having integral hinges or spring sections. In each instance, however, the suggested design involves only a simple hinge-like or compressive movement as those in the art would consider to be applicable primarily to push button or push clip type mechanisms involving simple transmission of linear forces.

U.S. Pat. No. 3,850,531 illustrates a pencil with an automatic lead feed mechanism in which the head of a drive screw is disposed between and revolved in steplike increments by a pair of opposed sets of angularly projecting rachet teeth. While suggesting conversion of reciprocal to rotary motion, this Patent does not hint at an integrant drive member, conversion of oscillating to reciprocating motion, or links mounted to swivel in a complex motion between folded and erect positions to alternately move a pair of sleeve sections toward and away from each other.

The devices illustrated in U.S. Pat. Nos.:

| | |
|---|---|
| 3680968 | 3349966 |
| 3721726 | 3331094 |
| 3379490 | 3203026 |
| 3351417 | 3169267 |

utilize helically arranged resilient plastic strips as spring elements for biasing a valve head, or the like, toward a closed position. Upon flexure, the resilient strips would be expected to impart a slight oscillatory motion to the valve head as it is moved in and out during use. Such an incidental and minor oscillatory motion, however, would not suggest an integrant drive member comprising a pair of sleeve sections, one being manually oscillable to reciprocate the other via a pair of links which swivel between folded and erect positions.

U.S. Pat. No. 3,771,881 illustrates a dispenser having a propel-repel mechanism utilizing a pleated web which unfolds in an "accordion" fashion to transmit rotary motion from a base member directly to a carrier to move the carrier up a helix or thread. The web is described as being of sufficient width and thickness to transmit rotary force without undue bending about its axis, but otherwise it obviously is not involved in support of the carrier. Such support is provided entirely by the helix or thread. Accordingly, the pleated web is in no way suggestive of links which are longitudinally stiff and which serve as the sole means of supporting a reciprocal sleeve portion against an axially applied pressure.

SUMMARY OF THE INVENTION

It is a principal object of the present invention to provide a simplified yet improved mechanism for a writing, marking or similar implement having a housing with a unit longitudinally reciprocal relative to the housing between retracted and extended positions in response to axial oscillation of a portion of the housing.

Another objective of this invention is the provision in the mechanism of a retractable type writing, marking or similar implement of an integrant drive member for converting oscillating to reciprocating motion.

A still further object of this invention is to provide an improved oscillable type mechanism for a writing instrument having a removable cap/mechanism assembly as disclosed in U.S. Pat. No. 4,025,204.

Yet another objective of this invention is the provision of an improved oscillable type mechanism which is greatly simplified in construction and assembly, which is inexpensive yet rugged and long lasting, which is readily adapted for use in various types of implements and which is convenient, simple and reliable in use.

In essence, the present invention is directed to an operating mechanism for a writing, marking or similar implement of the type having an elongate housing with a cap, sleeve or similar actuating portion mounted for axial oscillation relative to the housing to longitudinally reciprocate a unit between a retracted position within the housing and an extended position projecting through the forward or point end of the housing.

The operating mechanism includes a drive member disposed within the housing and formed of a semi-flexible synthetic resin. The drive member comprises a pair of coaxial sleeve sections and a pair of links. The links are disposed between and connected to the sleeve sections at pivot points which are located at diametrically opposed positions proximate the circumference of contiguous surfaces of the sleeves and which comprise thin flexible webs. Preferably, the sleeve sections, links and webs are molded as an integrant or one-piece casting of polypropylene or other similar thermoplastic resin capable of serving as a hinge or pivot when molded, coined or otherwise formed with a thin flexible cross section.

One of the sleeve sections is operatively engaged and conjointly oscillated with the actuating portion of the housing, and the other sleeve is operatively engaged and conjointly reciprocated with the unit. Included in the mechanism are means for restraining the one sleeve against longitudinal movement and the other sleeve against rotary movement. Thus, as the actuating portion is manually rotated back and forth by the user, the one sleeve section oscillates with the actuating portion and the other sleeve section reciprocates with the unit.

As the one sleeve section is oscillated between the limits of its arc of movement, the aforementioned webs or pivot points are rotated relative to each other between generally diametrically opposed and diametrically aligned positions. In length, the links are slightly less than the diameter of the sleeve sections. Thus, when folded to a generally transverse position, the links span the distance between the webs as disposed in their diametrically opposed position. When the webs are disposed in their diametrically aligned position, of course, the links are disposed in an erect generally longitudinal position between the sleeve sections.

It will be apparent, therefore, that as the actuating portion and one sleeve section are conjointly oscillated, the links will swivel around the webs or pivot points between a folded position disposed transversely across and pulling the sleeves together, and an erect position aligned longitudinally with and pushing the sleeves apart. As the one sleeve section is restrained against longitudinal movement, the other sleeve section will be reciprocated as a result of the swiveling of the links, and such movement will conjointly reciprocate the unit between its retracted and extended positions.

The above mentioned restraining means preferably comprises a tubular connecting member which is releasably engaged with the housing and in which the drive member is mounted. As a result of this releasable engagement, the operating mechanism is selectively removable to open the housing for changing or replacing the unit.

BRIEF DESCRIPTION OF THE DRAWINGS

FIG. 1 is a longitudinal sectional view of a ball point pen provided with an operating mechanism constructed in accordance with a preferred embodiment of the invention, the unit being disposed in an extended or point exposed position;

FIGS. 3 through 6 comprise a series of views of the drive member of the embodiment of FIG. 1, showing in succession the relationship of the sleeve sections and connecting links of the drive member as they move between extended and retracted positions, such figures including:

FIG. 3A showing in side elevation the connecting links disposed in an erect generally longitudinal position pushing the sleeve sections apart;

FIG. 3B showing a cross sectional view as taken on line B—B of FIG. 3A;

FIG. 3C showing in front elevation the connecting links disposed in a spaced, parallel relationship when positioned longitudinally as in FIG. 3A;

FIG. 4A showing in side elevation, reduced spacing between the sleeve sections and angular positioning of the connecting links after partial (approx. ⅓) relative rotation between the sleeve sections;

FIG. 4B showing a cross sectional view as taken on line B—B of FIG. 4C;

FIG. 4C showing in front elevation, reduced spacing between the links when disposed in the position illustrated in FIG. 4A;

FIG. 5A showing in side elevation still further reduced spacing between the sleeve sections and greater angular positioning of the links after still further (approx. ⅔) relative rotation of the sleeve sections;

FIG. 5B showing a cross sectional view as taken on line B—B of FIG. 5A;

FIG. 5C showing in front elevation a still further reduced spacing between the links when disposed in the position illustrated in FIG. 5A;

FIG. 6A showing in side elevation the connecting links disposed generally transversely between and pulling the sleeve sections together;

FIG. 6B showing a cross sectional view as taken on line B—B of FIG. 6A;

and FIG. 6C showing in front elevation the connecting links disposed in a proximate or abutting relationship when positioned transversely as in FIG. 6A.

DESCRIPTION OF THE PREFERRED EMBODIMENT

Figure 2:
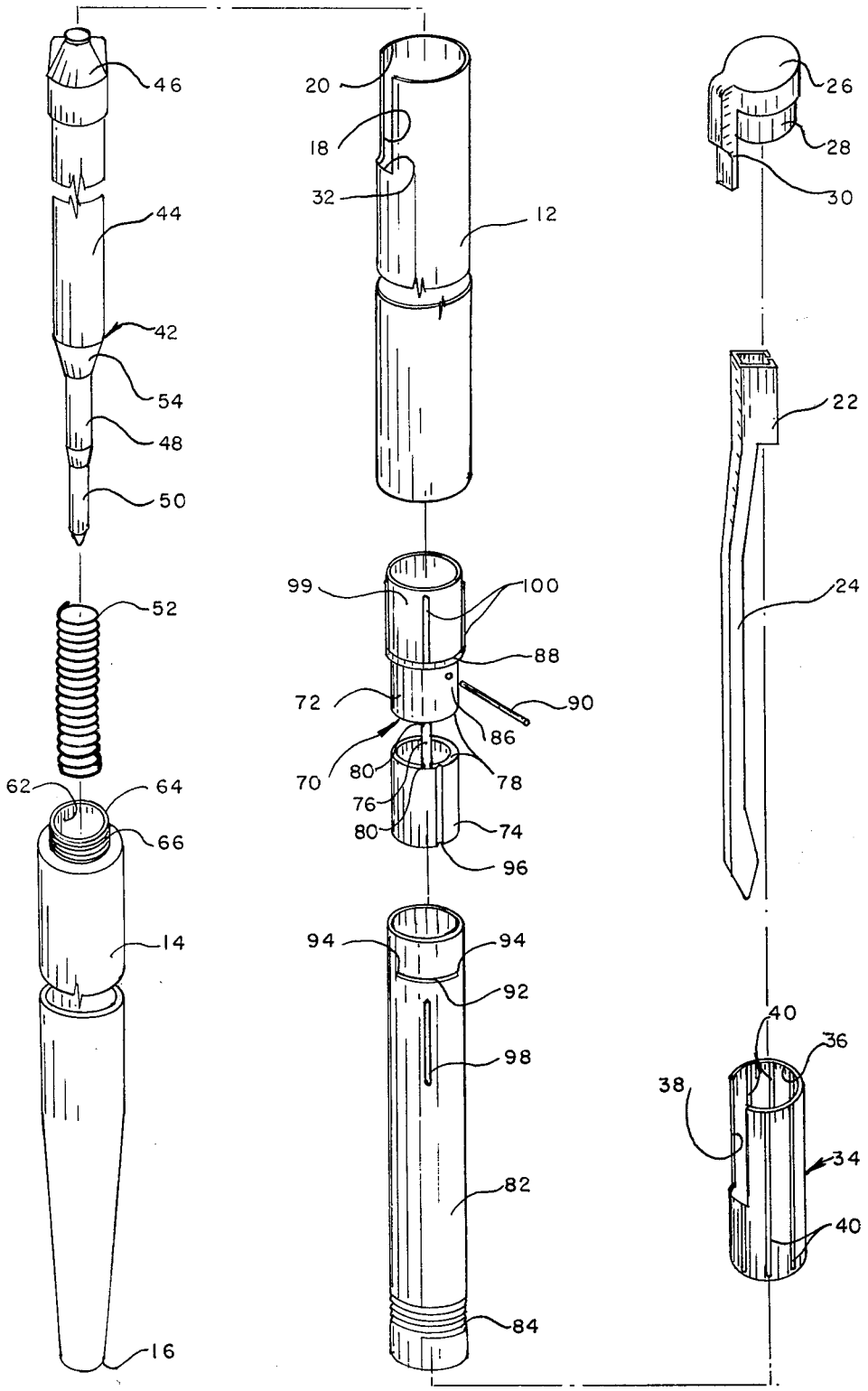
FIG. 2 is an exploded view showing the arrangement of the various parts of the embodiment of FIG. 1.

Referring now to the drawings and particularly to FIG. 1, there is illustrated a writing or marking implement having an elongate generally cylindrical housing 10, including a cap portion 12 and a coaxial barrel portion 14. The open lower end of cap 12 preferably is of the same diameter as and contiguous with the open upper end of barrel 14, thereby providing the housing 10 with a smooth unbroken exterior surface which is both attractive in appearance and comfortable in feel.

While cap and barrel portions 12 and 14 may be molded of an appropriate synthetic resin, preferably they are drawn or otherwise formed of a suitable metal such as brass, stainless steel or the like. The forward or lower end of barrel 14 is tapered to provide a reduced tip opening 16, and the exterior of both cap and barrel portions are then plated, chased, brushed, lacquered or otherwise finished to provide an attractive, slip resistant surface.

A longitudinally extending slot 18 (see FIG. 2) is formed in cap 12 adjacent to and extending through its open upper end 20. Disposed in slot 18 is a generally rectangular hollow box like mount portion 22 of pocket clip 24. Holding clip 24 in operating position is an insert 26 having a circular skirt 28 and a dependent tongue 30 sized to extend completely through the mount 22 and into engagement with the inner surface of cap 12 immediately below the lower edge 32 of slot 18.

Fixed within cap 12 is a tubular liner 34 having an open upper end 36 and a longitudinally extending slot 38, which open end and slot are aligned with open upper end 20 and slot 18 of cap 12. Slots 18 and 38 straddle the sides of clip mount 22 and hence prevent relative rotary displacement between clip 24, liner 34 and cap 12. To further assure against inadvertent disassembly of the afore-described cap assembly, the upper end of liner 34 preferably is both pressed over and staked to skirt 28 of insert 26, and pressed into and adhesively secured within cap 12.

As best shown in FIG. 2, the cylindrical wall of tubular liner 34 is provided with a series of circumferentially spaced longitudinal splines 40, the purpose of which will be explained in more detail hereinafter.

Disposed within housing 10 is a cartridge or unit 42, comprising an elongate cylindrical reservoir section 44, a rearward closure plug 46, a reduced forward feed section 48, and a ball type nib 50 supported by the feed section 48. As will be understood, the diameter of the nib 50 should be slightly less than the diameter of tip opening 16 to insure against any interference with movement of the nib through opening 16 between a retracted position and the illustrated extended writing position.

It will be further understood that while a ballpoint unit is illustrated and described in this application, the present invention is not limited to use with such units. Other types of writing and marking units and cartridges may be employed, as can other varieties of tools and dispensers, such as pointed scribes or applicators for make-up, antiseptics, and the like.

A coil spring 52 is disposed in barrel portion 14 around the feed section 48 of unit 42. One end of spring 52 stops against the interior of the tapered tip portion of barrel 14, and the other end engages the frusto-conical tapered section 54 joining reservoir 44 and feed 48 of unit 42. As will be readily understood, spring 52 normally biases unit 42 inwardly or rearwardly toward its concealed or retracted position.

Pressed within barrel 14 proximate the feed section 48 of unit 42 is a spring retainer 56 having a central aperature 58 through which feed section 48 freely reciprocates during movement of unit 42 between its retracted and extended positions. Spring retainer 56, of course, will both support the forward end of unit 42 against excessive sideways movement and maintain spring 52 in correct operating position against inadvertent removal during withdrawal of unit 42 from barrel 14 for replacement or other purposes.

A generally tubular connector sleeve 60 is press fitted or otherwise fixed within barrel 14, and provided with a central bore 62 through which the reservoir 44 of unit 42 is freely reciprocal. Extending from sleeve 60 rearwardly of barrel 14 is an annular collar 64, the outer periphery of which is provided with a thread section 66, the purpose of which will be explained herebelow.

Located within cap portion 12 adjacent the rearward end of unit 42 is an operating mechanism for reciprocating the unit between its aforementioned retracted and extended positions. Included as a part of the mechanism is a drive member 70, comprising a first or upper sleeve section 72, a second or lower sleeve section 74 and a pair of links or levers 76.

Although drive member 70 preferably is molded or cast as an integral or one piece component, the present invention does not exclude its fabrication from initially discrete elements using, for example, well known heat sealing, ultrasonic welding, snap-in socketing, or similar assembly techniques. Accordingly, as used herein, the term "integrant" or "one-piece" should not be taken as being limited to a multi-element component formed initially as a single or integral casting or molding.

In the preferred embodiment, however, the drive member 70 is cast or molded as a single or integral component from a semi-resilient synthetic resin such as a black polypropylene identified as PRO-FAX#6523. This material is produced by the Hercules Powder Co., Suite 500, 120 Oak Brook Center Mall, Oak Brook, Ill. 60521, and is colored by the Plastic Trading Co., Suite 107, 9470 West Foster Avenue, Chicago, Ill. 60556. As is well known in the art, polypropylene is capable of being molded, coined or otherwise formed as a thin flexible web which will withstand many thousands of flexures without fracturing. Thus, polypropylene generally is the material selected for use in forming what is popularly called a "living" or integral hinge.

Referring now to FIG. 3, the links 76 are disposed between contiguous surfaces 78 of the sleeve sections 72 and 74. The ends of the links 76 are connected or otherwise coupled to these contiguous surfaces 78 proximate their outer circumference by thin flexible webs 80. The webs 80 are integral with links 76 and sleeves 72 and 74, and serve as pivot points around which links 76 swivel as the sleeves and links move relative to each other during operation of the mechanism.

Drive member 70 is held in operating position within housing 10 by a tubular connector 82, the forward end of which includes a rolled thread section 84 releasably engaged with thread 66 of annular collar 64. Rearwardly, connector 82 extends into cap portion 12 and terminates in an open end sized to snugly but slidably receive lower sleeve section 74 and a reduced neck portion 86 of upper sleeve 72. The forwardly facing surface provided by the enlarged center ring 88 of upper sleeve section 72 abuts the rearward end of connector 82 to limit movement of sleeve 72 forwardly into connector 82. Retainer pin 90 is then driven transversely through slot 92 of connecting member 82 and into the neck portion 86 of upper sleeve 72 to prevent movement of sleeve 72 rearwardly from connector 82. Thus upper sleeve section 72 is longitudinally fixed but axially rotatable back and forth through an arc determined by opposite ends 94 of slot 92. In the preferred embodiment, the slot ends 94 are spaced apart a chordal distance which limits oscillation of upper sleeve section 72 through an arc of about 155°–160°.

As best illustrated in FIG. 2, the lower sleeve section 74 is formed with a pair of diametrically opposed longitudinal grooves 96 sized to slidably mate with a complimentary pair of splines 98 which are indented in connecting member 82 forwardly of slot 92.

Preferably, slots 96 are offset circumferentially about 15° from the pivots or webs 80 in a direction opposite to that in which the links swivel during operation of the mechanism.

It will be apparent, therefore, that the upper sleeve section 72 is restrained against longitudinal movement but permitted to rotate back and forth (oscillate), while the lower sleeve section 74 is restrained against rotary movement but permitted to shift up and down (reciprocate).

Oscillation of upper sleeve portion 72 is accomplished by manual oscillation of cap portion 12. Oscillatory movement of cap 12 is transmitted to sleeve 72 via its terminal end 99 which is frictionally but slidably engaged in tubular liner 34. As explained previously, liner 34 is fixed within cap 12, and provided with a series of splines 40 which mesh with a series of longitudinal splines 100 on terminal end 99 of sleeve section 72. Meshing of splines 40 and 100 will prevent any significant rotary slippage between sleeve 72 and liner 34, while not interfering with forward and rearward sliding movement of cap 12, as during its removal from or placement on the implement.

As will be obvious from FIGS. 3 through 6, links 76 should be relatively rigid along their longitudinal length as they comprise the sole support for the lower sleeve section 74 and abutting unit 42 when the implement is conditioned for writing, marking or other appropriate use. Also, it should be noted that in length, the links 76 are slightly less than the diameter of and hence will not extend radially beyond sleeve sections 72 and 74 even when disposed transversely of the sections.

Calling attention now to FIG. 3, it will be seen that the sleeve sections 72 and 74, links 76 and webs 80 are illustrated in the positions they normally assume when the unit 42 is extended for use. As thus positioned, the webs 80 of sleeve 72 are generally diametrically aligned with the webs 80 of sleeve 74, and the links 76 are disposed longitudinally between the webs as erect, parallel supports pushing the sleeve sections apart. Hence, forward sleeve section 74 and unit 42 are urged forwardly against the pressure of spring 52 to an extended position in which the writing point 50 projects through barrel opening 16.

In this position, retainer pin 90 is positioned against one end wall 94 of slot 92, which engagement prevents inadvertent movement of the parts past the "unit extended" position either as a result of rearward pressure on the unit 42 or overtravel by the user. Inadvertent reverse movement of the parts back toward the "unit concealed" position can be prevented by dimensioning the mechanism parts to develop a limited amount of frictional resistance or "drag" between relatively rotating or sliding surfaces.

FIGS. 4 and 5 illustrate the sleeve sections 72 and 74, links 76 and webs 80 as these elements of the drive member 70 rotate and/or swivel relative to each other during movement of the unit 42 between extended and retracted positions.

As disposed in the intermediate FIG. 4 position, the upper sleeve section 72 has rotated through a portion of its arc of movement, thereby rotating the webs 80 of upper sleeve 72 out of diametrical alignment with webs 80 of lower sleeve 74. As a consequence, links 76 have swiveled around both sets of webs 80, to what might best be described as a chordal position (see FIG. 4A) drawing or pulling lower sleeve 74 rearwardly. Spring 52, of course, biases unit 42 rearwardly conjointly with sleeve 74. Because of the positive pulling action of links 76, however, spring 52 could be deleted and unit 42 releasably coupled to and pulled rearwardly with lower sleeve section 74 to effect its retraction.

In the FIG. 5 position, the upper sleeve 72 has rotated through a further portion of its arc of movement. This, of course, results in further rotation of webs 80 relative to one another toward a generally diametrically opposed position and simultaneous movement of links 76 radially toward each other and the longitudinal axis of the drive member 70. The links thus are folded further toward a transverse position, pulling sleeve 74 and unit 42 additionally rearwardly.

As depicted in FIG. 6, the elements of the drive member 70 are disposed in their fully retracted position. In this position, the upper sleeve 72 has traversed the balance of its arc of movement to bring retainer pin 90 into contact with the other end wall 94 of slot 92; the webs 80 are disposed in a generally diametrically opposed position; and links 76 are transversely folded across the central part of the drive member 70 between contiguous surfaces of sleeves 72 and 74 to pull these sleeves together and the unit 42 rearwardly to its retracted position. Because of the width of the links 76, it will be appreciated that even when completely folded as shown in FIG. 6, they will prevent movement of pivots or webs 80 to a full diametrically opposed (180°) position. Also, the webs 80 may not be precisely aligned when disposed in the FIG. 3 position, but slightly beyond an aligned position to help insure against inadvertent retraction of sleeve 74 and unit 42 when under considerable rearwardly directed pressure. Thus, as used in this description and the following claims, such terms as "diametrically opposed", "diametrically aligned", and the like, are to be taken broadly as referring to a general disposition and not necessarily a precise position of elements.

As described and claimed in this application, the present invention provides a greatly simplified mechanism which is inexpensive and simple to produce and assemble yet which is rugged, reliable, long-lasting and convenient in use.

An instrument containing this mechanism, for example, does not require a unit having a special and costly adapter as do many of the prior art instruments. Further, the method of changing units involves only a simple rotation of the cap portion 12 relative to barrel 14 to threadedly disconnect and connect the connector 82 and collar 64. In many prior art implements, the unit replacement process is quite complicated and confusing.

In connection with unit replacement in the aforedescribed embodiment, the cap portion 12 may be removed by simply pulling it rearwardly from the housing 10. This exposes connector 82, which may then be unthreaded from barrel 14, and the unit 42 then replaced. Alternately, should the user not wish to remove the cap 12 preparatory to unit replacement, the cap can simply be rotated to first move the lower sleeve 74 and unit 42 rearwardly to the retracted position, in which the retainer pin 90 is in contact with one end surface 94 or slot 92, and then to disengage thread sections 66 and 84. The connector 82 and drive member 70 thus remain in cap 12, protected against inadvertent loss or damage. In replacing the cap 23 and mechanism, the opposite procedure is followed, whereby the unit is reciprocated to its extended position as a result of final tightening of the threads 66 and 84.

Such extension of lower sleeve 74 and unit 42, of course, involves a simple reversal of movement of the elements of drive member 70 as described in detail hereabove. It is not believed necessary, therefore, to again explain the sequence of the diverse motions of the elements, except to point out that as the upper sleeve is rotated through its arc, the lugs 76 will generate a substantial pushing force between the sleeves, particularly as the lugs approach their erect position and the spring 52 becomes compressed. Thus, as opposed to the usual "thread" type advancing device used in most prior art oscillable mechanisms wherein the generation of force is generally linear, the present mechanism will provide increasingly greater thrust as increasingly greater resistance is met. Also, it will be appreciated that the amount of travel of unit 42 as it reciprocates between its extended and retracted positions is limited to the approximate length of the links 76 between the points on the webs 80 around which the links swivel during actuation of the mechanism. And the length of the links 76 is limited by the diameter of that portion of the connector 82 and cap 12 through which the links operate. Accordingly, any significant increase in the amount of travel of unit 42 would require an increase in interior diameter of the connector 82 and cap 12 to accommodate larger sleeves 72 and 74 and longer links 76.

As a further point of information applicable to the production of the drive member 70 of the preferred embodiment, it has been found that in the molding operation, cylinder temperature preferably should be held in the 450° F. to 550° F. range, with mold temperatures of about 120° F. to 150° F. The plastic should be injected at high speed and the gate should be located in the larger of the two sleeve cavities and sized about 50% greater than normal. At least with the PRO-FAX material specified previously for use in the drive member, the webs 80 should be flexed as soon as possible after removal of the casting from the mold—such flexure including an initial slow flexure followed immediately by several rapid flexures. As will be understood by those in the art, preliminary flexing of the casting promptly after solidification will properly orient the molecules of the thin webs 80 and thereby assure a long service life.

This invention may be embodied in various forms and used with various types of units without departing from its spirit or essential characteristics. The embodiment described above, therefore, is to be considered only as illustrative and not as restrictive, with the scope of the invention being indicated by the appended claims. All changes which come within the meaning, scope or range of equivalency of the claims are therefore intended to be embraced therein.

We claim:

1. An operating mechanism for a writing or similar implement of the type having an elongate housing with an axially oscillable cap portion and a longitudinally reciprocal unit, said mechanism being characterized by (A) a drive member disposed within said housing and comprised of
  (i) an upper sleeve section oscillable conjointly with said cap portion,
  (ii) a lower sleeve section coaxial with said upper sleeve section and reciprocal conjointly with said unit,
  (iii) the lower surface of said upper sleeve section and the upper surface of said lower sleeve section being contiguous, and
  (iv) link means disposed between and pivoted on said sleeve sections at generally diametrically opposed points on said contiguous surfaces, (B) connecting means releasably coupling said drive member to said housing and supporting said upper sleeve section for said oscillable but against reciprocal movement and said lower sleeve section for said reciprocal but against rotary movement, (C) said link means swiveling around said pivot points in response to conjoint oscillation of said cap portion and said upper sleeve section, said link means swiveling around said pivot points between
  (i) a folded transverse position pulling said sleeves together and retracting said unit in response to relative rotation of said pivot points to a generally diametrically opposed position, and
  (ii) an erect longitudinal position pushing said sleeve sections apart and extending said unit in response to relative rotation of said pivot points to a generally diametrically aligned position.

2. An operating mechanism according to claim 1, characterized by the feature that said sleeve sections and said link means are molded integrally of a semi-flexible synthetic resin.

3. An operating mechanism according to claim 2, characterized by said link means being connected to said sleeve sections at said pivot points by thin flexible webs formed of said synthetic resin.

4. An operating mechanism according to claim 3, characterized by the features that sleeve sections are generally cylindrical and that said webs are positioned proximate the circumference of said contiguous surfaces.

5. A mechanism according to claim 4, characterized by the feature that in length said link means is no greater than the diameter of and does not project radially beyond said contiguous surfaces when swiveled to said folded transverse position.

6. An operating mechanism according to claim 5, characterized by the features that said link means comprises a pair of links and that each said sleeve section is provided with a pair of said flexible webs formed at generally diametrically opposed positions on said contiguous surfaces, said links being connected to and swiveling oppositely of one another around said flexible webs between (a) a folded position disposed generally parallel to one another transversely across said contiguous surfaces in response to relative rotation of said pairs of webs to a diametrically offset position and (b) an erect position disposed generally parallel to one another longitudinally between said contiguous surfaces in response to relative rotation of said pair of webs to a diametrically aligned position.

7. An operating mechanism according to claim 6, characterized by the features that said connecting means comprises a tubular connector threadedly engaged with said housing and extending therein to a position rearwardly of said unit, said drive member being carried by said connector rearwardly of said unit.

8. A mechanism according to claim 7, characterized by the features that said lower sleeve section, links and a forward portion of said upper sleeve section are disposed within and movable relative to said connector, and that said connector and said drive member comprise an assembly threadedly disengagable from said housing to permit access to said unit.

9. A mechanism according to claim 8, characterized by the features that a rearward portion of said upper sleeve section extends rearwardly of said connector, and that said cap portion is frictionally coupled to said rearward portion of said upper sleeve section.

10. A mechanism according to claim 9, characterized by the feature that said synthetic resin comprises polypropylene.

* * * * *